US010410487B2

(12) United States Patent
Joseph

(10) Patent No.: US 10,410,487 B2
(45) Date of Patent: Sep. 10, 2019

(54) SECURITY SYSTEM WITH FIXTURE AND TRACKING DEVICES FOR IN ROOM SECURITY OF VALUABLES

(71) Applicant: CARRIER CORPORATION, Palm Beach Gardens, FL (US)

(72) Inventor: Ajit Clarence Joseph, Bangalore (IN)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 15/780,497

(22) PCT Filed: Dec. 2, 2016

(86) PCT No.: PCT/US2016/064570

§ 371 (c)(1),
(2) Date: May 31, 2018

(87) PCT Pub. No.: WO2017/096135

PCT Pub. Date: Jun. 8, 2017

(65) Prior Publication Data

US 2019/0005784 A1 Jan. 3, 2019

Related U.S. Application Data

(60) Provisional application No. 62/263,055, filed on Dec. 4, 2015.

(51) Int. Cl.
*G08B 13/14* (2006.01)

(52) U.S. Cl.
CPC ..... *G08B 13/1436* (2013.01); *G08B 13/1481* (2013.01)

(58) Field of Classification Search
CPC ..... G08B 13/1436; G08B 13/1481
See application file for complete search history.

(56) References Cited

U.S. PATENT DOCUMENTS

| | | | | |
|---|---|---|---|---|
| 7,170,407 | B2 | 1/2007 | Wagner | |
| 7,796,035 | B2 | 9/2010 | Hallbert et al. | |
| 7,916,025 | B2 | 3/2011 | Locker et al. | |
| 8,717,165 | B2 | 5/2014 | Gemandt et al. | |
| 8,742,922 | B2 | 6/2014 | Ferrari | |
| 8,896,422 | B2 | 11/2014 | Koch et al. | |
| 2004/0084525 | A1 | 5/2004 | Kreiner et al. | |
| 2005/0040229 | A1 | 2/2005 | Andrews et al. | |
| 2008/0117072 | A1* | 5/2008 | Hallbert | G06F 21/552 340/670 |
| 2010/0097208 | A1 | 4/2010 | Rosing et al. | |
| 2010/0302025 | A1 | 12/2010 | Script | |
| 2012/0146793 | A1 | 6/2012 | Wood | |

(Continued)

FOREIGN PATENT DOCUMENTS

EP 1926064 A1 5/2008

OTHER PUBLICATIONS

US 5,075,441 A, 06/2000, Maloney (withdrawn)

(Continued)

*Primary Examiner* — Leon Flores
(74) *Attorney, Agent, or Firm* — Bachman & LaPointe, P.C.

(57) ABSTRACT

A security system includes an fixture and a tracking device in wireless communication with the fixture to communicate a disturbance to the tracking device.

7 Claims, 3 Drawing Sheets

(56) References Cited

U.S. PATENT DOCUMENTS

| | | | | |
|---|---|---|---|---|
| 2012/0285206 | A1 | 11/2012 | Favier | |
| 2014/0210624 | A1* | 7/2014 | Wandel | E05B 73/0017 340/572.1 |
| 2015/0379795 | A1* | 12/2015 | Wu | G07C 9/00309 340/5.61 |
| 2016/0116178 | A1* | 4/2016 | Vega | F24F 11/52 700/276 |
| 2016/0222699 | A1* | 8/2016 | Grant | E05B 73/0047 |

OTHER PUBLICATIONS

International Search Report dated May 10, 2017 for corresponding International Application No. PCT/US2016/064570.
< http://www.ekahau.com/real-time-location-system/technology/wi-fi-tags >.
< http://www.stanleysecurity.co.uk/19-solutions/asset-tracking >.
< http://cybra.com/hotel-rfid-software/ >.
< https://www.stoptheft.comistop-monitor >.
< http://cdn.intechopen.com/pdfs/6177.pdf >.

* cited by examiner

SECURITY SYSTEM WITH FIXTURE AND TRACKING DEVICES FOR IN ROOM SECURITY OF VALUABLES

CROSS-REFERENCE TO RELATED APPLICATION

Benefit is claimed of U.S. Patent application No. 62/263,055, filed Dec. 4, 2015, and entitled "Security System With Fixture And Tracking Devices For In Room Security Of Valuables", the disclosure of which is incorporated by reference herein in its entirety as if set forth at length.

BACKGROUND

The present disclosure relates to a security system and, more particularly, to a security system that pairs an fixture and one or more tracking devices.

An access control system is typically operated by encoding data on a physical key card that indicates access rights. Some access control systems are offline and the access rights are encoded as data that can be decoded and interpreted by the offline lock to retrieve the access rights. An example is a hotel locking system where a front desk encodes a guest card and an offline, battery powered lock on a guest room door has the means to decode the card and permit or deny access based on the encoded access rights.

Although effective to control access to a local such as a hotel room, it has been noticed that valuables of the guest can be readily removed from the local once access is gained. Although effective, hotel staff and maintenance have access to the guest rooms and enter the room for miscellaneous purposes regardless of the lock.

SUMMARY

A security system according to one disclosed non-limiting embodiment of the present disclosure can include a tracking device in wireless communication with the fixture to communicate a disturbance to the tracking device.

A further embodiment of the present disclosure may include, wherein the fixture is attached to a building.

A further embodiment of the present disclosure may include, wherein the fixture is attached to a door.

A further embodiment of the present disclosure may include, wherein the fixture is an electromechanical lock.

A further embodiment of the present disclosure may include, wherein the fixture is a security panel.

A further embodiment of the present disclosure may include, wherein the fixture is a thermostat.

A further embodiment of the present disclosure may include, wherein the disturbance includes movement.

A further embodiment of the present disclosure may include, wherein the disturbance includes light.

A further embodiment of the present disclosure may include, wherein the tracking device is operable to determine a relative position with respect to the fixture and communicate the position to the fixture.

A further embodiment of the present disclosure may include, wherein the tracking device is operable to determine a global position and communicate the position to the fixture.

A method of operating a security system, the method according to another disclosed non-limiting embodiment of the present disclosure can include determining a disturbance of a tracking device; and communicating the disturbance to a fixture.

A further embodiment of the present disclosure may include attaching the tracking device to a valuable.

A further embodiment of the present disclosure may include positioning the tracking device within a valuable.

A further embodiment of the present disclosure may include, wherein determining the disturbance includes identifying movement of the tracking device.

A further embodiment of the present disclosure may include, wherein determining the disturbance includes identifying a change in light.

A further embodiment of the present disclosure may include determining a relative position of the tracking device to an fixture.

A further embodiment of the present disclosure may include, wherein the fixture includes an electromechanical lock.

An electromechanical lock according to another disclosed non-limiting embodiment of the present disclosure can include a lock transceiver operable to wirelessly communicate with a remote tracking device in response to a disturbance of the tracking device.

A further embodiment of the present disclosure may include, wherein the disturbance includes a change in light measured by the tracking device.

A further embodiment of the present disclosure may include, wherein the disturbance includes a movement measured by the tracking device.

A further embodiment of the present disclosure may include, wherein the wirelessly communication includes usage of a Bluetooth Low energy wireless protocol.

The foregoing features and elements may be combined in various combinations without exclusivity, unless expressly indicated otherwise. These features and elements as well as the operation thereof will become more apparent in light of the following description and the accompanying drawings. It should be appreciated, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
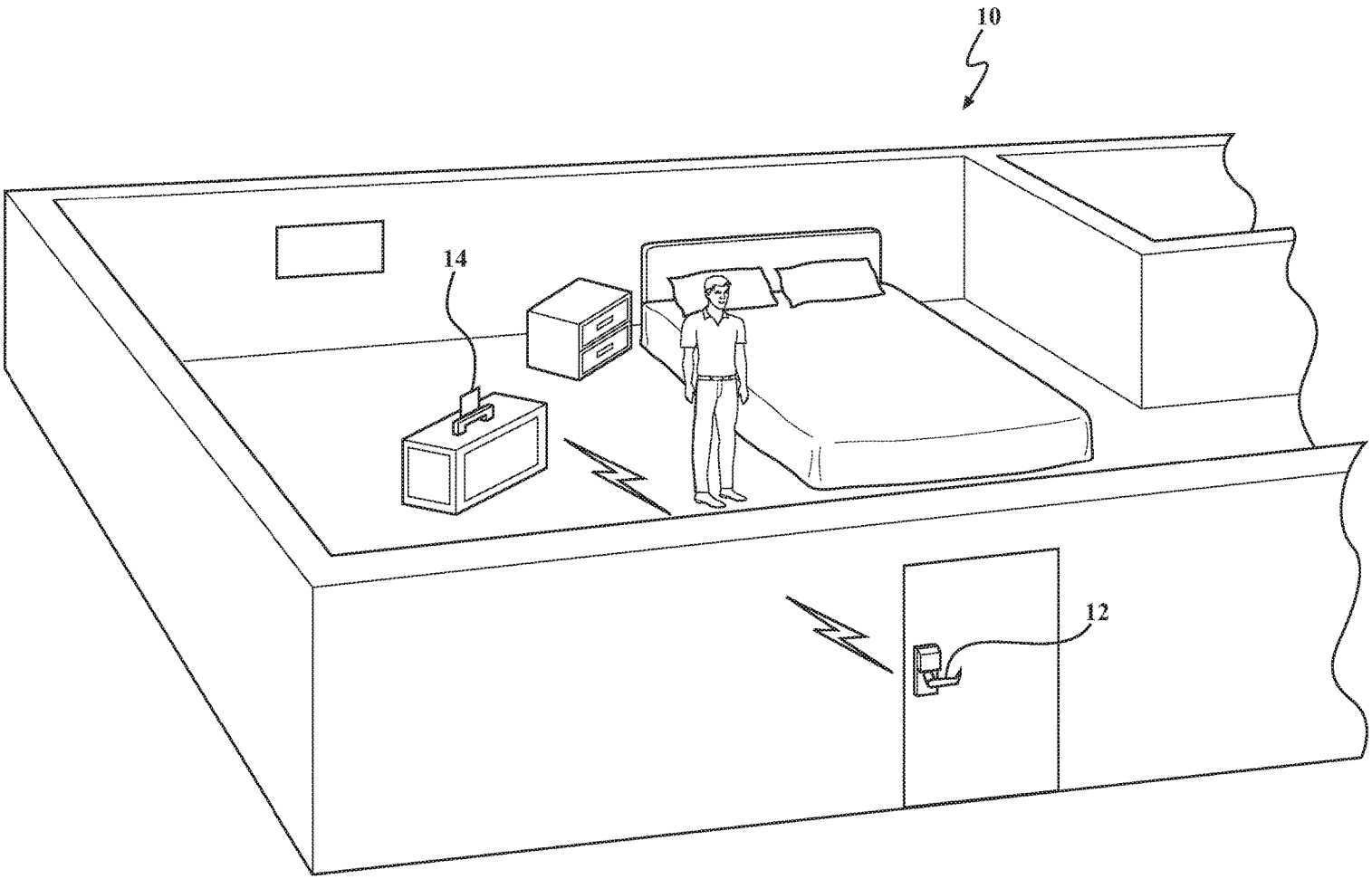
FIG. 1 is a schematic view of a security system according to one disclosed non-limiting embodiment.

FIG. 1 schematically illustrates a security system 10. The security system 10 generally includes a fixture 12 and one or more tracking devices 14 attached to the valuable. It should be appreciated that the fixture 12 may be a wireless-capable, restricted-access, or restricted-use device such as a wireless lock, a security panel, access control readers for building entry, electronic banking controls, data transfer devices, key dispenser devices, tool dispensing devices, and other restricted-use machines. Alternatively, the fixture 12 may be another type of device that is fixed in location such as a thermostat.

A user may submit a credential to an electromechanical lock to unlock it, and thereby gain access to a restricted area. In another example, a user may submit a credential to an electronic banking control such as an ATM to withdraw funds. In still another example, the user may submit the credential to a unit that dispenses key cards with data associated with or data retrieved from the credential. A mobile device 16 such as a key card, smartphone, or other device may store credentials for one or all or other of the examples noted above, and in addition may store a plurality of credentials for each type of application at the same time.

It should be still further appreciated that although particular systems are separately defined, each or any of the systems may be otherwise combined or separated via hardware and/or software. The communication may be conveyed to one or more networks. For example, the communication may be transmitted to the Internet and/or a cellular network. The network(s) may include infrastructure that may be organized to facilitate cloud computing. For example, cloud computing may include one or more servers, such as a primary message server, a backup message server, etc.

Figure 2:
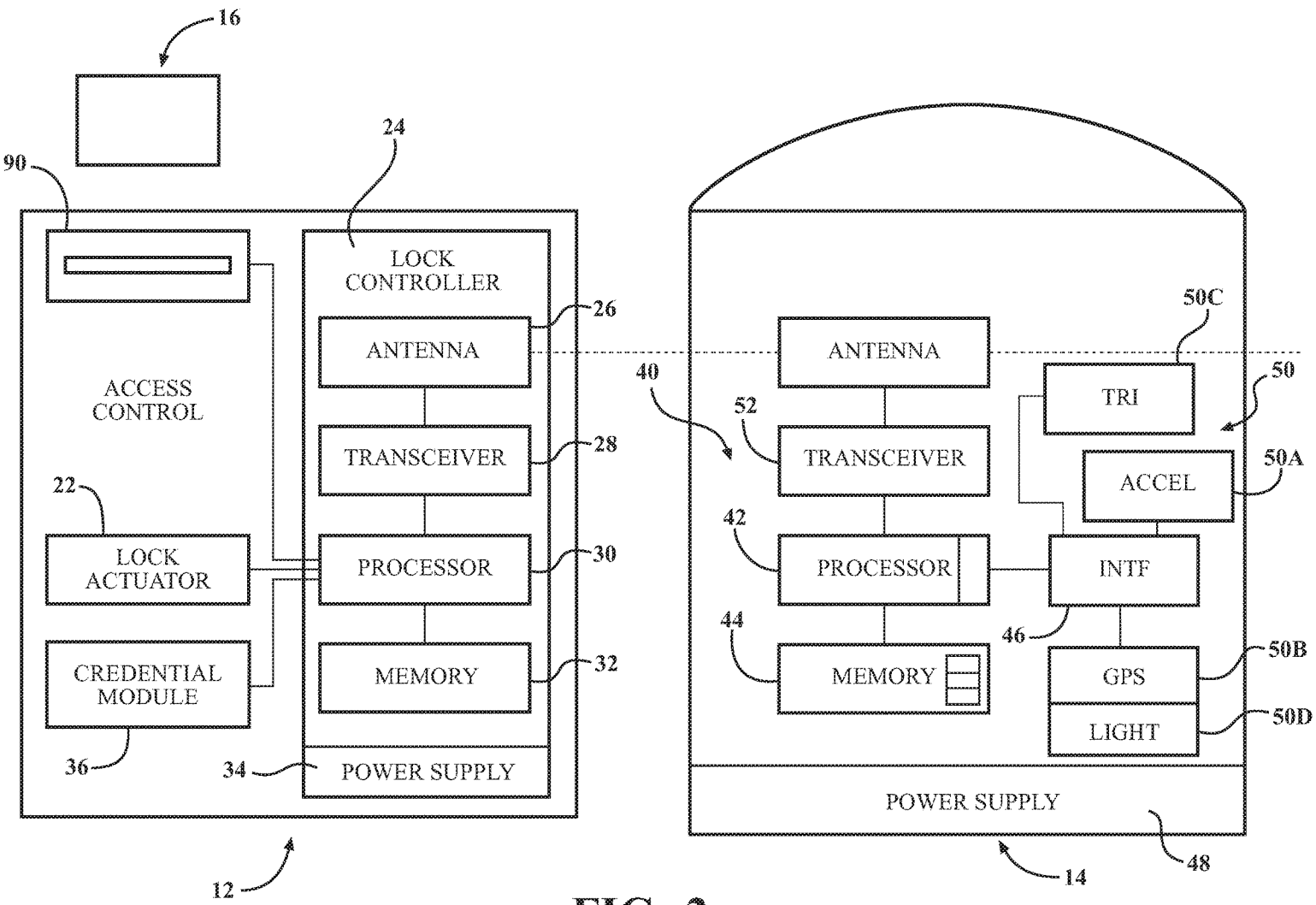
FIG. 2 is a block diagram of the security system.

With reference to FIG. 2, a block diagram of the fixture 12 is schematically illustrated. In this example, the fixture 12 is depicted as an electromechanical lock system, however, other fixtures will benefit herefrom. A "fixture" as utilized is a device that is affixed to a building or other structure.

The fixture 12 generally includes a lock actuator 22, a lock controller 24, a lock antenna 26, a lock transceiver 28, a lock processor 30, a lock memory 32, a lock power supply 34, a lock card reader 90 and a credential module 36. The fixture 12 is responsive to credentials from a keycard or other mobile device 16, and may, for example, be the lock of a lockbox, a door lock, or a lock core. Upon receiving and authenticating an appropriate credential, the lock controller 24 commands the lock actuator 22 to lock or unlock a mechanical or electromechanical lock. The lock controller 24 and the lock actuator 22 may be parts of a single electronic or electromechanical lock unit, or may be components sold or installed separately.

The lock transceiver 28 is operable to transmit and receive data to and from at least the mobile device 16. The lock transceiver 28 may, for instance, utilize a near field communication (NFC), Bluetooth, or Wi-Fi transceiver, or another appropriate wireless transceiver. The lock antenna 26 is any antenna appropriate to the lock transceiver 28. The lock processor 30 and lock memory 32 are, respectively, data processing, and storage devices. The lock processor 30 may, for instance, be a microprocessor that can process instructions to validate card data and determine the access rights contained in the card data or to pass messages from a transceiver to a credential module 36 and to receive a response indication back from the credential module 36 with card data. The lock memory 32 may be RAM, EEPROM, or other storage medium where the lock processor 30 can read and write data including but not limited to lock configuration options and the lock audit trail. The lock audit trail may be a unified audit trail that includes events initiated by accessing the lock via the lock card reader 90 or the mobile device 16. The lock power supply 34 is a power source such as line power connection, a power scavenging system, or a battery that powers the lock controller 24. In other embodiments, the lock power supply 34 may only power the lock controller 24, with the lock actuator 22 powered primarily or entirely by another source, such as user work (e.g. turning a bolt).

The lock transceiver 28 is also operable to communicate with the tracking devices 14. The tracking devices 14 may be initially paired to the lock transceiver 28, via, for example, a 'learn' mode for learning a tracking device and associating therewith. Alternatively, or in addition, this may be based on proximity—i.e. the lock transceiver 28 will respond to a tracking device based on distance. The communication can include any wireless ISM band and protocol to include, for example, Bluetooth Low energy wireless protocol. The tracking device 14 may be of various configurations such as a hook and loop strap, a bankcard, sticking materials, a user's mobile device, and various tags that lock to an item.(valuable)

Figure 3:
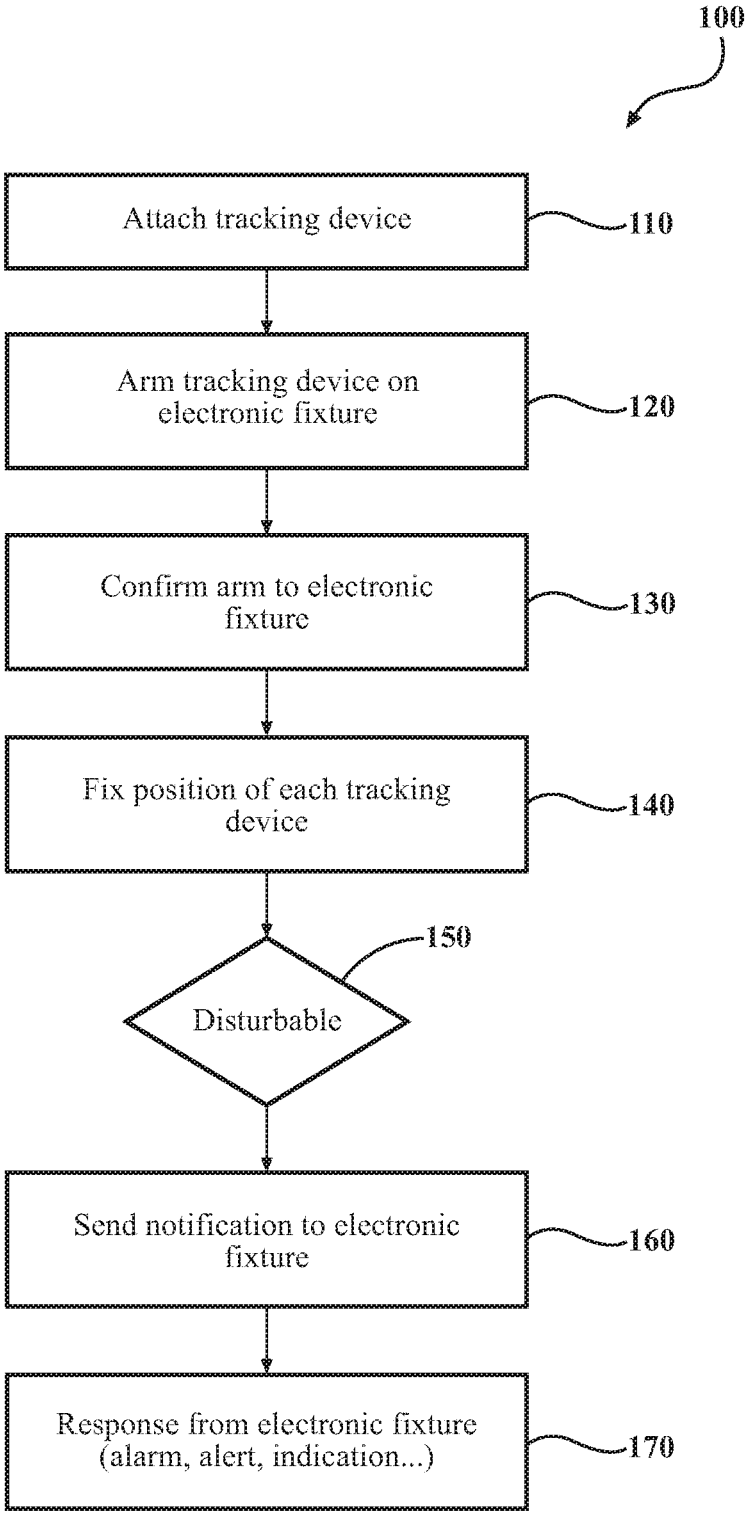
FIG. 3 is a block diagram for an operational use case of the security system according to one disclosed non-limiting embodiment.

Each tracking device 14 may generally include a control module 40 with a processor 42, a memory 44, and an interface 46. A power supply 48, such as a battery, and a position module 50 operable to determine the position of the tracking device 14, and transceiver module 52 are in communication with the processor 42 via the interface 46. The position module 50 is operable to determine movement of the tracking device 14. For example, the position module 50 may include an accelerometer 50A to identify movement, a global positioning system (GPS) 50B, and/or a triangulation system 50C that determines the position of the tracking device 14 with respect to the fixture 12 based, for example, on a signal strength thereof. Alternatively, or in addition, the position module 50 may include a light sensor 50D to identify when a bag is opened and luminous would change for a tracking device 14 located within a bag With reference to FIG. 3, a method 100 for operation of the security system 10 is disclosed in terms of functional block diagrams. It should be appreciated that these functions may be enacted in either dedicated hardware circuitry or programmed software routines capable of execution in various microprocessor based electronics control embodiments.

Initially, a guest physically attaches a tracking device 14 to his valuable (e.g. luggage) (step 110) using for example a loop strap. Then fixture and tracking device are wirelessly attached by getting them paired and putting them into learning mode. These modes can be achieved by sequencing and timing the push buttons in tracking device and the fixture. Once pairing mode and learning mode is complete even when the authorized guest is in the room, the tracking device 14 is inoperative or in a safe condition.

Next, when the guest leaves the room, the guest arms the wirelessly connected tracking device 14 (step 120) by, for example, pushing a button on the fixture 12, e.g., the electromechanical lock, via a mobile app on a smartphone, or other interface. This arming may be effectuated via an authentication procedure. For example, arm the tracking device, a mobile device may be used to authenticate the fixture 12 with a credential and also supply a command to 'arm' the tracking devices 14. It should be appreciated that multiple tracking devices 14 may be so authenticated.

The tracking device 14 then sends a confirmation signal to the fixture 12 along with the current status (step 130). The confirmation signal may be displayed on the mobile device or via an indicator on the fixture 12. The relative position with respect to the fixture 12, or a global position of the tracking device 14, is then fixed in the armed condition (step 140).

Should a thief disturb the valuable (step 150), which creates motion, movement and potentially light should a bag be opened, the tracking device 14 then sends a notification signal to the fixture 12 (step 160). Upon return of the guest, the guest can be notified by the fixture 12 that motion/movement of his valuable occurred. Alternatively, the guest may be alerted in real time via an app on a smartphone should the fixture 12 be connected through the Internet or other communication medium. The guest can then check his valuables to determine if any item is missing. Alternatively still, multiple fixtures 12 may be utilized to track the tracking device 14 such as should the bag be moved down a hallways with multiple fixtures 12.

The fixture 12 can alternatively or additionally sounds an alarm, show an indication, and/or send an alert to hotel security (step 170). This may also be utilized to generate audits/access logs in the fixture 12 about the motion and movement for later investigation. That is, the open and movement audits may be sequenced with the access events in the fixture 12 along with timestamps to identify, for example, a cleaning crew entry access associated with the open and movement events in a sequence of timestamps. When there is a movement of the valuable, the audit would be logged with the time stamp, access information, and location, which can facilitate identification and location of the valuable. The timestamp will also facilitate investigation of the valuable's movement. One advantage usage with electromechanical locks is that the tagged valuable has to move through the door/lock which can create access, as well as facilitate movement audit trails.

The tracking device 14 can be unarmed in response to a valid and authenticated access event such as return of the owner so that the fixture 12 will unarm the tracking devices 14 when the guest returns to the room. Unarm operation can be made with preferences from guest, where the guest can unarm a few valuables and maintain some armed.

Increased security of valuables minimizes concern of guests when they leave their the hotel rooms. This will also facilitate in tracking and investigating of the valuables. This will increase customer satisfaction with electromechanical locks.

The elements disclosed and depicted herein, including in flow charts and block diagrams throughout the figures, imply logical boundaries between the elements. However, according to software or hardware engineering practices, the depicted elements and the functions thereof may be implemented on machines through computer executable media having a processor capable of executing program instructions stored thereon as a monolithic software structure, as standalone software modules, or as modules that employ external routines, code, services, and so forth, dynamically loaded or updated modules, or any combination of these, and all such implementations may be within the scope of the present disclosure.

It should be appreciated that like reference numerals identify corresponding or similar elements throughout the several drawings. It should also be appreciated that although a particular component arrangement is disclosed in the illustrated embodiment, other arrangements will benefit herefrom.

Although the different non-limiting embodiments have specific illustrated components, the embodiments are not limited to those particular combinations. It is possible to use some of the components or features from any of the non-limiting embodiments in combination with features or components from any of the other non-limiting embodiments.

Although particular step sequences are shown, disclosed, and claimed, it should be appreciated that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically disclosed. For that reason the appended claims should be studied to determine true scope and content.

What is claimed is:

1. A security system, comprising: a fixture an electromechanical lock; and a tracking device operable to determine a relative position with respect to the electromechanical lock and wirelessly communicate the position via a Bluetooth Low energy wireless protocol to communicate a disturbance to the electromechanical lock, wherein the disturbance includes at least one of a movement and a change in light, and the electromechanical lock generates an audit trail of the tracking device.

2. The system as recited in claim 1, wherein the tracking device is operable to determine a global position and communicate the position to the fixture.

3. A method of operating a security system, the method comprising:

determining a disturbance of a tracking device, wherein the disturbance includes at least one of movement and a change in light;

communicating the disturbance to an electromechanical lock;

determining a relative position of the tracking device to the electromechanical lock; and generating an audit trail of the tracking device by the electromechanical lock.

4. The method as recited in claim 3, further comprising attaching the tracking device to a valuable.

5. The method as recited in claim 3, further comprising positioning the tracking device within a valuable.

6. An electromechanical lock, comprising: a lock transceiver operable to wirelessly communicate with a tracking device in response to a disturbance of the tracking device, wherein the tracking device operable to determine a relative position with respect to the electromechanical lock and wirelessly communicate the position via a Bluetooth Low energy wireless protocol, wherein the disturbance includes at least one of a movement and a change in light, and the electromechanical lock generates an audit trail of the tracking device.

7. The system as recited in claim 6, wherein the audit trail includes a time associate with the tracking device passage of the lock transceiver.

* * * * *